US009103182B2

(12) United States Patent
Sinnott et al.

(10) Patent No.: US 9,103,182 B2
(45) Date of Patent: Aug. 11, 2015

(54) METAL-TO-METAL SEALING ARRANGEMENT FOR CONTROL LINE AND METHOD OF USING SAME

(75) Inventors: James A. Sinnott, Paisley (GB); Arlane Christie, Balmedie (GB); Laura Campbell, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 774 days.

(21) Appl. No.: 13/338,921

(22) Filed: Dec. 28, 2011

(65) Prior Publication Data

US 2013/0168104 A1 Jul. 4, 2013

(51) Int. Cl.
*E21B 33/038* (2006.01)

(52) U.S. Cl.
CPC ..... *E21B 33/038* (2013.01)

(58) Field of Classification Search
USPC ..... 166/386, 387, 85.1, 88.1, 88.2, 88.4
See application file for complete search history.

(56) References Cited

U.S. PATENT DOCUMENTS

| | | | | |
|---|---|---|---|---|
| 3,089,543 | A * | 5/1963 | Raulins | 166/71 |
| 3,739,846 | A | 6/1973 | Beson | |
| 3,965,977 | A | 6/1976 | Beson | |
| 4,589,492 | A * | 5/1986 | Greiner et al. | 166/338 |
| 4,595,053 | A | 6/1986 | Watkins et al. | |
| 4,607,691 | A | 8/1986 | Bridges | |
| 4,665,979 | A | 5/1987 | Boehm, Jr. | |
| 4,790,572 | A | 12/1988 | Slyker | |
| 4,932,472 | A | 6/1990 | Boehm, Jr. | |
| 4,949,786 | A | 8/1990 | Eckert et al. | |
| 4,960,172 | A | 10/1990 | Nelson | |
| 5,067,734 | A | 11/1991 | Boehm, Jr. | |
| 5,285,853 | A | 2/1994 | Eckert et al. | |
| 5,456,314 | A | 10/1995 | Boehm, Jr. | |
| 5,685,369 | A | 11/1997 | Ellis et al. | |
| 6,050,338 | A | 4/2000 | Watkins | |
| 6,367,558 | B1 | 4/2002 | Borak, Jr. | |
| 6,394,837 | B1 * | 5/2002 | Edwards et al. | 439/426 |
| 7,165,620 | B2 | 1/2007 | Steedman | |
| 7,762,319 | B2 | 7/2010 | Nelson | |
| 7,861,789 | B2 | 1/2011 | Nelson | |
| 8,146,670 | B2 | 4/2012 | Ellis et al. | |
| 8,186,426 | B2 | 5/2012 | Nelson | |
| 8,205,670 | B2 | 6/2012 | Nelson | |

(Continued)

FOREIGN PATENT DOCUMENTS

| | | |
|---|---|---|
| GB | 2307928 A | 6/1997 |
| GB | 2356210 A | 5/2001 |
| GB | 2396176 A | 6/2004 |

OTHER PUBLICATIONS

U.S. Appl. No. 13/275,884, filed Oct. 18, 2011, entitled "Soft Skin Metal Seal and Technique of Manufacture".

(Continued)

*Primary Examiner* — William P Neuder
*Assistant Examiner* — Richard Alker
(74) *Attorney, Agent, or Firm* — Bracewell & Giuliani LLP

(57) ABSTRACT

A well completion system includes a wellhead, a control line assembly for use in completions that is mounted to the wellhead, and a tubing hanger. The control line assembly includes a cylinder, a main housing assembly, a passage and a metal-to-metal seal. A split lockout ring provides a positive lock to the passage. Control lines enter the tubing hanger and exit via the wellhead. This arrangement on the wellhead provides sufficient height and clearance to allow for the installation of a plurality of control lines.

19 Claims, 3 Drawing Sheets

Fig 3A

(56) References Cited

U.S. PATENT DOCUMENTS

| | | | | |
|---|---|---|---|---|
| 8,312,922 | B2 | 11/2012 | Nelson | |
| 2005/0067167 | A1* | 3/2005 | Hall et al. | 166/379 |
| 2010/0038089 | A1 | 2/2010 | Gette et al. | |
| 2011/0316236 | A1 | 12/2011 | Gette et al. | |
| 2012/0025470 | A1 | 2/2012 | Gette | |
| 2012/0085554 | A1 | 4/2012 | Gette et al. | |
| 2012/0098203 | A1 | 4/2012 | Duong | |
| 2012/0118585 | A1 | 5/2012 | Duong | |
| 2012/0187634 | A1 | 7/2012 | Adamek | |
| 2012/0241175 | A1 | 9/2012 | Galle et al. | |
| 2012/0247788 | A1 | 10/2012 | Ford et al. | |
| 2013/0000920 | A1 | 1/2013 | Duong | |

OTHER PUBLICATIONS

U.S. Appl. No. 13/730,306, filed Dec. 28, 2012, entitled "Seal with Flexible Nose for Use with a Lock-Down Ring on a Hanger in a Wellbore".

U.S. Appl. No. 13/310,172, filed Dec. 2, 2011, entitled "Seal with Bellows Type Nose Ring".

U.S. Appl. No. 13/428,898, filed Mar. 23, 2012, entitled "Wellhead Assembly Having a Sinusoidal Sealing Profile and a Method to Assemble the Same".

U.S. Appl. No. 13/659,499, filed Oct. 24, 2012, entitled "Hard Stop Energizing Ring".

U.S. Appl. No. 13/644,914, filed Oct. 4, 2012,entitied "Semi-Rigid Lockdown Device".

U.S. Appl. No. 13/678,166, filed Nov. 15, 2012, entitled "Slotted Metal Seal".

U.S. Appl. No. 13/612,062, filed Sep. 12, 2012, entitled "Annulus Seal with Stepped Energizing Ring".

U.S. Appl. No. 13/706,179, filed Dec. 5, 2012, entitled "Packoff Sealing Assembly".

Search Report from corresponding GB Application No. GB1222445.7 dated Feb. 25, 2013.

* cited by examiner

METAL-TO-METAL SEALING ARRANGEMENT FOR CONTROL LINE AND METHOD OF USING SAME

FIELD OF THE INVENTION

This invention relates to oilfield completion systems and, in particular, to a wellhead completion system having a metal-to-metal sealing arrangement for control lines installed on a surface wellhead.

BACKGROUND OF THE INVENTION

For many surface and subsea oil and gas wells, a series of pipes, fittings, valves, and gauges are used on a wellhead to control the flow and achieve well completion. A Christmas or production tree is generally attached to the wellhead and the pipes, fittings, valves and gauges are typically routed and connected to the tree. One, or a plurality of, penetrators or stems, may be installed in a Christmas tree to engage components installed within the wellhead, such as a tubing hanger. The penetrators may be horizontal, vertical, or at other angles, and allow downhole control lines, such as electrical and/or hydraulic, to be routed through the tree and tubing hanger sidewalls and be routed down to components below the wellhead.

Subsea horizontal tree tubing hangers generally utilize a sealing arrangement for control lines that rely on the weight of completion tubing to activate the device sealing mechanism. On conventional surface wellhead applications, however, there is insufficient space available on most completions to incorporate this sealing arrangement Well completions are now using an increasing number of downhole control lines with some operators now requesting up to eleven separate control lines. As explained above, the conventional method of exiting a plurality of control lines through the wellhead usually requires that the control line pass through a tubing hanger in a continuous manner and then exit through the wellhead body. However, large numbers of control lines make this conventional exit arrangement complex and difficult to complete within the limited space available in the wellhead upper bowl area. Fitting multiple control lines in the limited space currently available is difficult and labor intensive, with control lines frequently bent in awkward directions with some having to physically cross over others. Control lines are thus frequently damaged. Thus, little space on this particular completion arrangement is left to provide "spare" length on the control line.

Further, if any problems are encountered during the control line termination phase through the wellhead, it may be necessary to pull the completion, which is an expensive and time-consuming exercise involving significant rig downtime.

A need exists for a technique to allow sufficient clearance for a plurality of downhole control lines at a well.

SUMMARY OF THE INVENTION

In an embodiment of the invention, a well completion includes a wellhead, a control line assembly, and a tubing hanger. The wellhead may have a generally cylindrical body with a bore. The control line assembly may include a cylinder and a main housing assembly with a flange with a bolt pattern at one end for mounting to the wellhead body via bolts. The control line assembly may further include a passage and a metal-to-metal seal. The passage may be a tube or stem within the cylinder that has an inlet at an exterior end and extends into the wellhead bore at another end. A split lockout ring provides a positive lock to the passage. A plurality of control line assemblies may be mounted to the wellhead. The well completion described herein may also be used in production casing hangers to run control lines down through a production annulus.

The tubing hanger may have a plurality of vertical passages formed in a sidewall of the hanger that communicates with well components, such as valves or instrumentation devices, within the well and below the tubing hanger. Further, a plurality of radial passages communicate with the vertical passages at one end and communicate radially with an outer surface of the tubing hanger. The tubing hanger may be landed within the bore of the wellhead and oriented such that the radial passages in the tubing hanger align with each of the passages of each of the control line assemblies.

This arrangement on the wellhead of the control line assemblies advantageously provides sufficient height and clearance to allow for the installation of a plurality of control lines entering into the tubing hanger and exiting from the wellhead.

This invention provides several additional advantages. The invention advantageously overcomes the problem of bending and fitting multiple control lines in the limited space available by moving the exit point down to the main wellhead body and creates multiple control line entry points on the tubing hanger body with a minimal height increase. The multiple control lines can be accommodated in a "single band" around the tubing hanger and wellhead body thereby minimizing any height impact. In addition, safety for personnel is improved by this invention given that work around an open well, which may involve working underneath suspended BOP stacks, is minimized. From an operational safety standpoint, hydraulic control line communication can be advantageously achieved immediately after the tubing hanger has landed in the wellhead without the need to break the BOP stack and thereby maintaining complete well control. Further, as the mating stem seal surface on the tubing hanger body is below the main outer diameter of tubing hanger body, seal surface is protected from damage during tubing hanger installation operations through a BOP stack. This invention further reduces risk of control line damage and reduces the risk of the cost and downtime related to pulling a completion. Further, the invention provides metal-to-metal sealing, which is particularly suitable for critical and high pressure/high temperature applications, is tamper-proof, and reduces rig down time during the control line termination process. Further, the invention provides immediate communication with downhole hydraulic lines once the tubing hanger is landed. The control line assemblies can also be retrofitted onto an existing wellhead as required by the number of downhole control lines required. The invention also provides a lower cost alternative to comparable third-party exit valve arrangements.

DETAILED DESCRIPTION OF THE INVENTION

Figure 1:
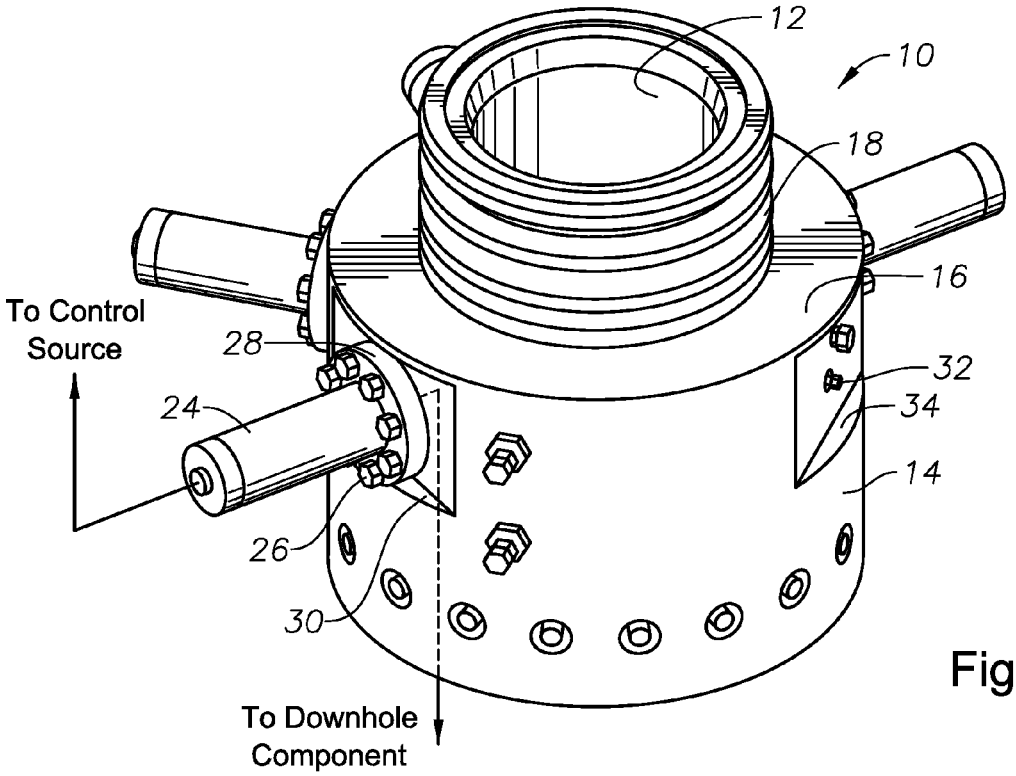
FIG. 1, is a perspective view of an embodiment of a wellhead, in accordance with the invention.

FIG. 1 shows a perspective view of an embodiment of a generally cylindrical wellhead 10 having a bore 12, that may be installed on a surface or subsea well. In this embodiment, the wellhead 10 further has a body or wellhead body 14 with a sidewall 16. The sidewall may have a radial thickness defined generally by a difference between an outer surface of the body 14 and an upper connection 18. The upper connection 18 shown has a generally cylindrical shape, although the upper connection can take the form of a flange, and extends upward from the body 14 of the wellhead 10.

Figure 2:
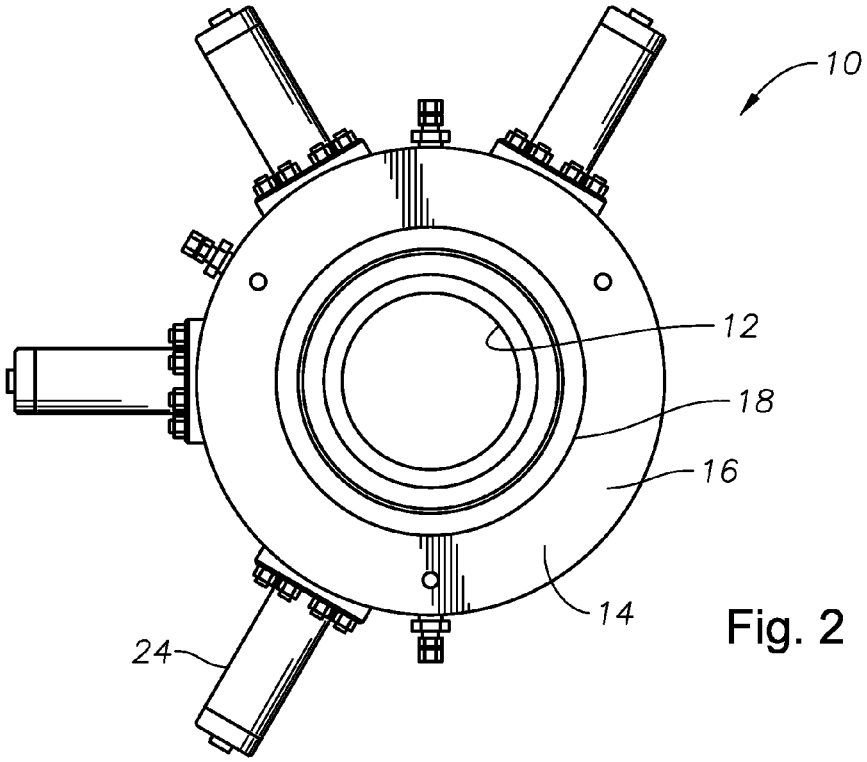
FIG. 2, is a top view of the wellhead of FIG. 1.

Continuing to refer to FIG. 1 and also FIG. 2, a control line assembly 24, which may be one of a plurality of assemblies, is mounted to the body 14 of the wellhead 10 via bolts 26. The bolts 26 pass through bolt passages (not shown) in a flange 28 on a mounting end of the control line assembly 24 and further engage corresponding bolt passages (not shown) formed in the body 14 of the wellhead 10. The flange 28 of the control assembly 24 is received by a recess 30 formed on the outer surface of the wellhead body 14. The flange 28 may be a standard API flange or some form of compact flange design. A seal ring 29 (FIG. 3) may be located between the flange 28 and the wellhead body 14 to effect a seal. In the embodiment of FIGS. 1 and 2, the control line assembly 24 extends radially outward from the wellhead 10 and horizontally. However, the assembly 24 could also extend outward at an angle from horizontal. The number of control line assemblies 24 and other connections may vary with the requirements of the well completion. The control line assembly 24 and instrumental signal port 32 will be explained further below.

Figures 3, 3A:
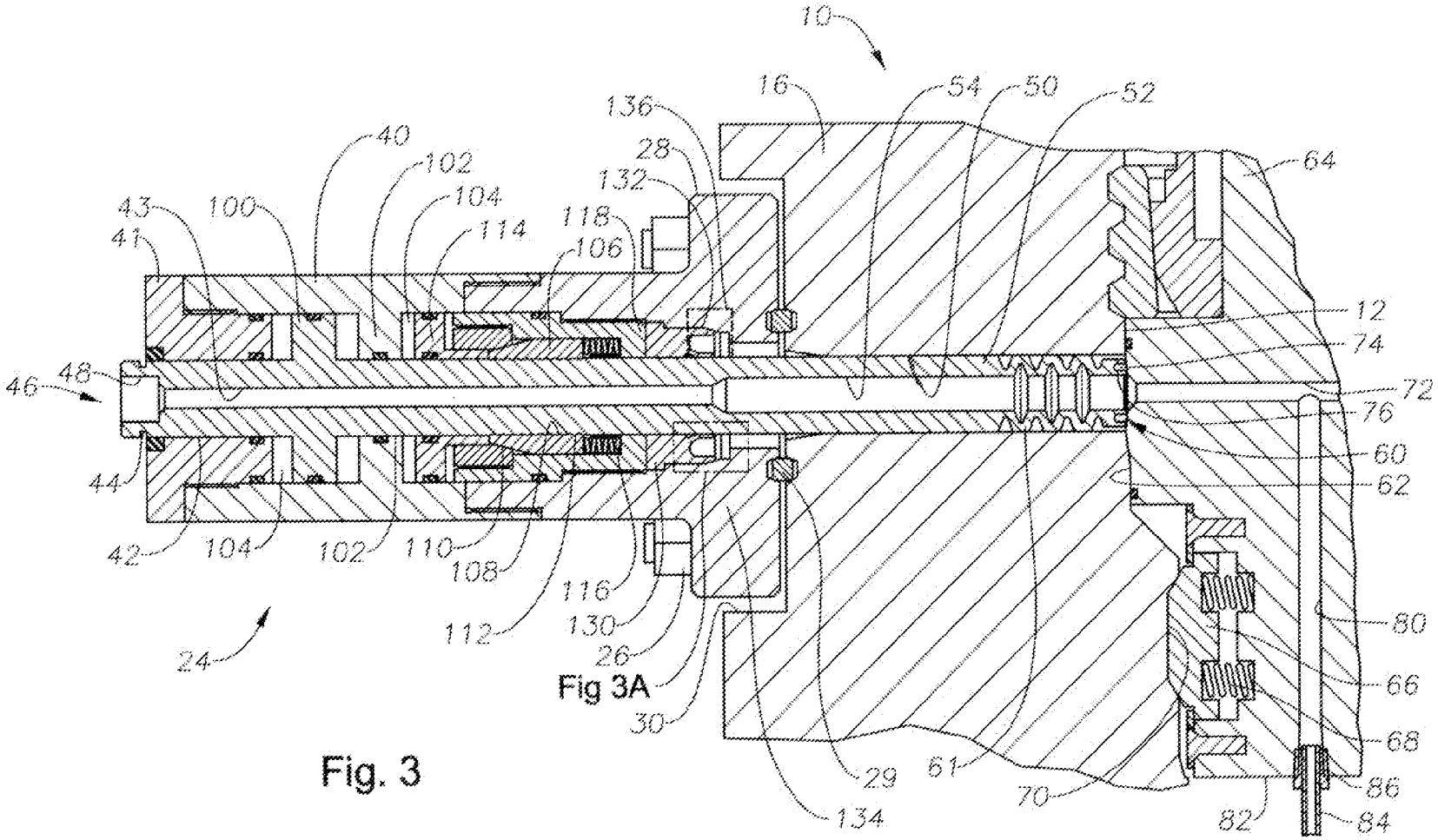
FIG. 3, is a partial sectional view of an embodiment of a control line assembly mounted to the wellhead, in accordance with the invention.
FIG. 3A, is an enlarged view of a portion of FIG. 3, in accordance with the invention.
Figure 3A:
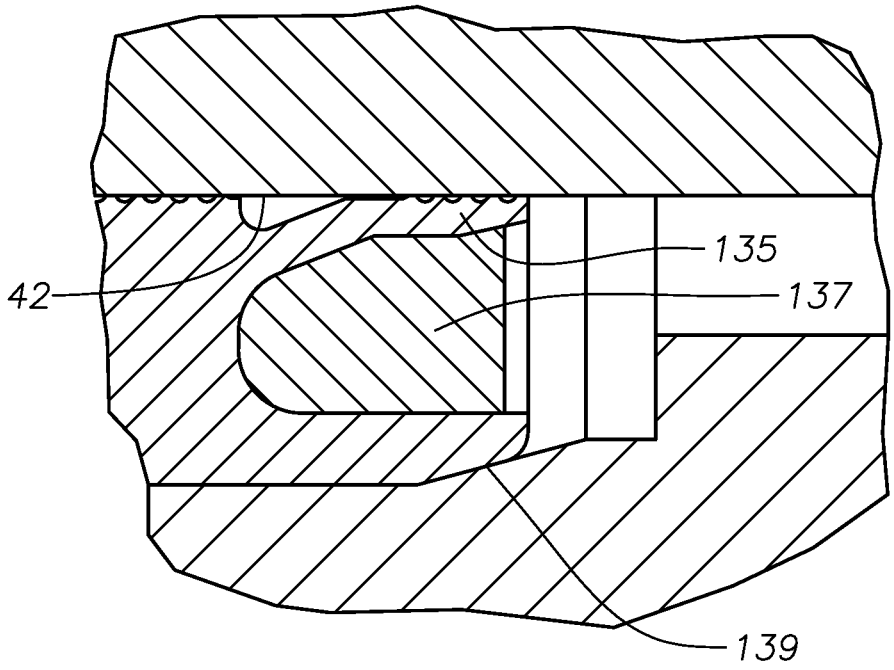

Referring to FIG. 3, a portion of the wellhead 10 having the control line assembly 24 is illustrated in side sectional view. The control line assembly 24 has an outer cylinder 40 fitted with an end cap 41 to define, in part, a hydraulic cylinder. A penetrator or stem 42 having an axial passage 43 with an inner diameter is located within the cylinder 40 and has an indicator or recess 44 at an outer end 46. The indicator 44 is formed on a circumferential periphery of the stem 42 and indicates when the stem 42 is properly installed within the wellhead body 14. The indicator 44 is on a portion of the stem 42 that projects past the end cap 41. The stem 42 has a control line inlet 48 at the outer end 46 that may allow connection to control sources such as a hydraulic supply. A horizontal passage 50 traverses the wellhead sidewall 16 to communicate the outer surface of the wellhead body 14 with the bore 12. Horizontal passage 50 allows a penetrating end 52 of the stem 42 to pass through wellhead sidewall 14. In this embodiment, passage 43 increases to a diameter 54 within the penetrating end 52 of the stem 42.

Continuing to refer to FIG. 3, the penetrating end 52 of stem 42 has a nose arrangement 60 terminating at penetrating end 52. Nose arrangement 60 has a wave-like profile 61 which is located within horizontal passage 50. The nose arrangement 60 of the stem 42 corresponds with bore 12 of the wellhead 10 and interfaces with an exterior surface 62 of a tubing hanger 64 shown landed within the wellhead 10. When energized against the tubing hanger 64 interface, the nose arrangement 60 creates a metal-to-metal seal. In this embodiment, tubing hanger 64 is properly aligned with the control line assembly 24 via a key 66 located at a lower portion of tubing hanger 64. The key 64 is outwardly biased by at least one spring 68. Key 66 is retracted until the key is received by a corresponding recess 70 formed in wellhead bore 12. Other types of alignment mechanisms may also be utilized. When tubing hanger 64 is properly aligned within the wellhead 10, a horizontal hanger passage 72 registers with nose arrangement 60 to establish communication with passage 43 of stem 42. An annular metal seal 74 is located within a seat 76 formed at nose arrangement 60 to seal at interface formed by nose arrangement and horizontal hanger passage 72. In this embodiment, horizontal passage 72 intersectingly communicates with a vertical hanger passage 80. Vertical hanger passage 80 further communicates with a lower surface 82 of tubing hanger 64 to allow communication with a line 84 that may connect to an inlet 86 located at lower end of vertical hanger passage. Line 84 may serve various types of components located below the hanger 64.

Continuing to refer to FIG. 3, a hydraulic piston 100 in this embodiment is formed integral with the stem 42 and allows the stem to reciprocate axially within a distance defined by end cap 41 and a stop 102 that projects radially inward from cylinder 40. As significant force is required to activate the nose arrangement 60 and set the metal-to-metal seal at the tubing hanger 64, a chamber 104 may be pressurized to deliver a distributed force to a back face of piston 100 to move piston, and thus stem 42, forward into sealing engagement with tubing hanger 64. The chamber is defined by the cylinder 40, end cap 41, stop 102, and hydraulic piston 100. Chamber 104 may also be pressurized on front face of piston 100 by an external source (not shown) to cause piston to retract, allowing retrieval of the tubing hanger 64. When the stem 42 is in a fully engaged position with tubing hanger 64, indicator mark 44 on the outer end 46 provides visual indication to the operator that the metal-to-metal seal is set.

Continuing to refer to FIG. 3, once stem 42 is set against tubing hanger 64, the stem 42 may be positively locked in place by a split lockout ring 106 to thereby prevent loss of sealing. The split lockout ring 106 has a toothed inner profile 108 and a tapered rear surface 110. The toothed inner profile 108 lockingly engages a corresponding mating profile 112 formed on an outer surface of stem 42. Mating profile 112 may also have a toothed profile. Tooth profiles on the split lockout ring 106 and mating profile 112 may have varying depths depending on the application. The split lockout ring 106 is held off stem 42 by a hydraulic lockout piston 114 while stem 42 is energized and set. This hydraulic locking mechanism acts as a safety measure in that there are no external components which can be tampered with or accidentally activated to unset the locking mechanism. An operator must physically connect a hydraulic supply to an inlet port (not shown) on the control line assembly 24 and apply pressure. Once stem 42 is set against the tubing hanger 64, pressure is released from the lockout piston 114 and the split lockout ring 106 is then driven down onto mating tooth profile 112 by a wave spring 116 to positively lock the stem 42 in place. Wave spring 116 is located at one end to split lockout ring 106 and at a second end to an internal housing 118 concentric with the stem 42. Wave spring 116 has a flat face at each end to engage mating component faces.

Continuing to refer to FIG. 3, a metal-to-metal seal 130 may also be effected between stem 42 and a main housing assembly 134 and a flexible metal seal lip 135 which sealingly engages outer surface of the stem as shown in FIG. 3A. The seal lip 135 is in interference contact with the stem 42, with this sealing arrangement further enhanced by any pressure present in the wellhead bore 12. An inside surface of the lip 135 may have a plurality of sealing lands or raised faces which initially form an interference seal and then progressively increases the sealing contact as the pressure in the wellhead bore 12 increases. The seal lip 135 partially defines an inner dynamic seal 137 (FIG. 3A). This is achieved by a metal seal ring 132 concentric with stem 42 that sealingly engages the main housing assembly 134 to form outer static seal 139 (FIG. 3A). In this embodiment, a stem seal area 136 of outer surface of stem 42 may be have a tungsten carbide coating so the stem seal area 136 can withstand forces applied by the flexible metal seal lip 135 that may result in galling between the stem 42 and flexible lip. Metal-to-metal seal 130 of stem 42 with main housing assembly 134 and metal-to-metal seal of nose arrangement 60 with tubing hanger 64 may both be verified via a test port (not shown) on the main housing assembly 134. The outer static seal 139 utilizes a metal-to-metal seal ring profile which effects a seal by elastic deformation of a seal lip opposite the metal seal lip 135 when made-up to the main housing assembly 134. In this embodiment, the metal-to-metal seal assembly is installed in the main housing body 134 and then the internal housing 118 is threaded in with this process energizing the outer static seal 139. The stem 42 is then inserted through the inner dynamic seal 135 followed by remaining components, including 116 and 106.

In one example, during installation of the control line assembly 24, the control line assembly is mounted to wellhead body 14 such that the penetrating end 52 of the stem 42 enters the horizontal passage 50 formed in the wellhead sidewall 16. To energize and set the metal-to-metal seal between the nose arrangement 60 and previously landed tubing hanger 64 via annular metal seal 74, chamber 104 is pressurized at a front face of piston 100 to move piston, and thus stem 42, forward. Sufficient force is generated by piston 100 to force metal seal 74 into sealing engagement with tubing hanger 64. To retract stem 42 and allow retrieval of tubing hanger 64, chamber 104 may be depressurized or pressurized on front face of piston 100 to cause piston to retract as a force exerted by the wave spring 116 drives the split lockout ring 106 and lockout piston 114 back to the original, deenergized position. When the stem 42 is in a fully engaged position with tubing hanger 64, indicator mark 44 on the outer end 46 provides visual indication to the operator that the metal-to-metal seal at nose arrangement 60 is set. Once stem 42 is set against tubing hanger 64, the stem is positively locked in place by the split lockout ring 106 to thereby prevent loss of sealing at the nose arrangement 60. During the setting operation the split lockout ring 106 is held off stem 42 by hydraulic lockout piston 114. The lockout piston 114 is depressurized once stem 42 is set. Wave spring 116 then forces the split lockout ring 106 to move forward and the toothed inner profile 108 of lockout ring then lockingly engages corresponding mating profile 112 formed on outer surface of stem 42. Metal-to-metal seal 130 may also be effected between stem 42 and main housing assembly 134 when the stem is locked in place.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A control line assembly for a surface wellhead, comprising:

a main housing assembly having an end selectively mounted to the wellhead;

a stem in the housing assembly;

a penetrating end on the stem extending through a passage in the wellhead;

a metal seal ring located at the penetrating end for sealingly engaging a tubing hanger installed within the wellhead when energized;

a locking ring that circumscribes the stem and that is in selective restraining contact with the stem; and a hydraulically actuated locking piston that is in engaging contact with the locking ring.

2. The assembly of claim 1, further comprising:

a radial projection extending from the stem; and a cylinder adapted to be pressurized via hydraulic fluid, wherein the hydraulic fluid exerts a distributed force on the radial projection of the stem to force the stem forward to thereby energize the metal seal ring at the penetrating end against the tubing hanger.

3. The assembly of claim 1, further comprising a recess formed on the exterior end of the stem that indicates when metal seal ring on the penetrating end of the stem is set against the tubing hanger, the recess located on the stem such that the recess is visible.

4. The assembly of claim 1, wherein the locking piston initially maintains the locking ring off of a mating profile of the stem during setting of the metal seal ring; and wherein the locking ring has a toothed inner profile for lockingly engaging the mating profile of the stem to lock the stem in place.

5. The assembly of claim 4, wherein the locking ring is split to define a split locking ring, and wherein a spring is located within the main housing assembly and interfaces with the split locking ring to drive the locking ring forward into mating engagement with the mating profile of the stem after the lockout piston is depressurized.

6. The assembly of claim 1, wherein the penetrating end comprises a bellows-like structure.

7. The assembly of claim 6, wherein a mating profile is formed on an outer surface of the stem.

8. A well completion system, comprising:

a wellhead having a body with a bore and a sidewall, the wellhead having at least one horizontal wellhead passage extending through the sidewall;

a tubing hanger located within the bore of the wellhead having a hanger passage, a control line assembly comprising:

a main housing assembly having an end selectively mounted to the wellhead;

a stem in the housing assembly;

a penetrating end on the stem extending through the horizontal wellhead passage in the wellhead;

a hydraulically actuated locking assembly comprising a locking ring that circumscribes the stem and that is in selective restraining contact with the stem, and a hydraulically actuated lockout piston that is in engaging contact with the locking ring, the locking assembly being in selective securing engagement with the stem so that the stem is maintained in a setting position against the tubing hanger; and a metal seal ring located at the penetrating end for sealingly engaging a tubing hanger installed within the wellhead when energized.

9. The system of claim 8, further comprising:

a radial projection extending from the stem; and a cylinder adapted to be pressurized via hydraulic fluid, wherein the hydraulic fluid exerts a distributed force on the radial projection of the stem to force the stem forward to thereby energize the metal seal ring at the penetrating end against the tubing hanger.

10. The system of claim 8, further comprising a recess formed on the exterior end of the stem that indicates when metal seal ring on the penetrating end of the stem is set against the tubing hanger, the recess located on the stem such that the recess is visible.

11. The system of claim 8, wherein the lockout piston is initially maintaining the locking ring off of a mating profile of the stem during setting of metal seal ring;

wherein the locking ring has a toothed inner profile for lockingly engaging the mating profile of the stem to lock the stem in place.

12. The system of claim 11, wherein the stem in the housing assembly is connected to a hydraulic source.

13. The system of claim 8, further comprising a secondary metal seal ring concentric with the stem for sealing between the stem and the main housing assembly.

14. The system of claim 13, wherein at least one horizontal and at least one vertical hanger passage intersectingly communicate with each other;

the horizontal hanger passage registers with the horizontal wellhead passage; and the vertical hanger passage communicates with a lower surface of the tubing hanger.

15. The system of claim 14, further comprising:

a key located at a lower portion of the tubing hanger; and a recess formed in the wellhead bore for receiving the key; wherein, the key is outwardly biased by at least one spring; and the key is received by the recess when the at least one horizontal hanger passage is aligned with the horizontal wellhead passage.

16. The system of claim 14, wherein the at least one horizontal hanger passage has an exit point on the tubing hanger located above a tubing hanger entry point of the at least one vertical hanger passage.

17. A method of controlling a device in a wellbore, comprising:

providing a control line assembly:

a main housing assembly having an end selectively mounted to the wellhead;

a stem in the housing assembly;

a penetrating end on the stem extending through a passage in the wellhead; and a metal seal ring located at the penetrating end for sealingly engaging a tubing hanger installed within the wellhead when energized;

contacting a sealing end of the penetrating end with a control passage in the wellhead so that a passage in the stem registers with the control passage and defines an interface between the sealing end and the wellhead;

sealing the interface by maintaining a contact force on the stem;

pressurizing a lockdown piston to maintain a locking ring off of the mating profile of the stem during energizing of the metal seal ring; and flowing a control fluid through the passage in the stem and into the control passage.

18. The method of claim 17, further comprising:

pressurizing a cylinder circumscribing the stem to force the stem forward to energize the metal seal ring.

19. The method of claim 17, further comprising:

setting a secondary metal seal ring to effect a seal between the main housing assembly and the stem.

* * * * *